US010392140B2

(12) United States Patent
Siegel et al.

(10) Patent No.: US 10,392,140 B2
(45) Date of Patent: Aug. 27, 2019

(54) AUTOMATED SOLID PHARMACEUTICAL PRODUCT PACKAGING MACHINE

(71) Applicant: MTS Medication Technologies, Inc., St. Petersburg, FL (US)

(72) Inventors: Todd Siegel, St. Petersburg, FL (US); Stuart Bagley, St. Petersburg, FL (US); Michael Stevenson, St. Petersburg, FL (US)

(73) Assignee: MTS Medication Technologies, Inc., St. Petersburg, FL (US)

( * ) Notice: Subject to any disclaimer, the term of this patent is extended or adjusted under 35 U.S.C. 154(b) by 977 days.

(21) Appl. No.: 13/971,670

(22) Filed: Aug. 20, 2013

(65) Prior Publication Data

US 2013/0340391 A1 Dec. 26, 2013

Related U.S. Application Data

(60) Division of application No. 12/786,138, filed on May 24, 2010, now Pat. No. 8,516,781, which is a division (Continued)

(51) Int. Cl.
*B65B 5/10* (2006.01)

(52) U.S. Cl.
CPC ..... *B65B 5/103* (2013.01)

(58) Field of Classification Search
CPC ..... B65B 5/103; B65B 35/06; B65B 5/101; B65B 21/18

(Continued)

(56) References Cited

U.S. PATENT DOCUMENTS 1,258,012 A 3/1918 Jedel
1,993,619 A 3/1935 Neff et al.

(Continued)

FOREIGN PATENT DOCUMENTS

DE 35 41 672 A1 5/1987
WO 01/74666 A1 10/2001

OTHER PUBLICATIONS

Tosho Inc.; Sales brochure for "Automatic Tablet Packing Machine BPM/CE"; Jun. 1, 1998; Japan.

(Continued)

*Primary Examiner* — Sameh Tawfik
(74) *Attorney, Agent, or Firm* — Kilpatrick Townsend & Stockton LLP

(57) ABSTRACT

A fully automated pharmaceutical product packaging machine is capable of selectively depositing one or more different solid pharmaceutical products into an individual cavity for each of a plurality of individual patient product package cavities. The system employs a plurality of solid pharmaceutical product dispensing canisters which are capable of selectively dispensing a pre-designated number of solid pharmaceutical products. The machine fills a template containing temporary storage cavities and the template is automatically positioned over a sheet of clear plastic material containing a plurality of cavities corresponding to the cavities in the template. A barrier between the cavities in the template and the sheet of clear plastic material is moved and the pharmaceuticals in the template cavities drop into the corresponding cavities in the clear plastic sheet of material. The clear plastic sheet of material is then maneuvered into subsequent product packaging stations and the template is returned to beneath the canister region.

20 Claims, 7 Drawing Sheets

Related U.S. Application Data of application No. 11/616,227, filed on Dec. 26, 2006, now Pat. No. 7,721,512, which is a continuation of application No. 09/539,834, filed on Mar. 31, 2000, now Pat. No. 7,185,476.

(60) Provisional application No. 60/133,647, filed on May 11, 1999.

(58) Field of Classification Search
USPC ..... 53/246, 154, 560
See application file for complete search history.

(56) References Cited

U.S. PATENT DOCUMENTS 3,139,713 A * 7/1964 Merrill ..... B65B 5/103 53/202
3,456,424 A 7/1969 Thurston et al.
3,568,735 A * 3/1971 Lancaster ..... G01N 35/1074 141/238
3,780,856 A 12/1973 Braverman
4,233,799 A * 11/1980 Caille ..... B65B 35/40 53/154
4,416,375 A 11/1983 Braverman et al.
4,490,963 A 1/1985 Knudsen
4,546,901 A 10/1985 Buttarazzi
4,554,839 A * 11/1985 Hewett ..... B01L 3/5085 422/561
4,621,665 A * 11/1986 Webb ..... B01L 3/0203 141/1
4,655,026 A * 4/1987 Wigoda ..... B65B 5/103 53/131.3
4,664,289 A 5/1987 Shimizu et al.
4,693,057 A 9/1987 Rittinger et al.
4,733,362 A 3/1988 Haraguchi
4,834,264 A * 5/1989 Siegel ..... B65B 5/103 221/200
4,844,246 A 7/1989 Harrison et al.
4,860,899 A 8/1989 McKee
4,870,799 A 10/1989 Bergerioux et al.
5,011,779 A * 4/1991 Maimon ..... B01L 3/0293 422/504
5,014,851 A * 5/1991 Wick ..... A61J 1/035 206/461
5,019,125 A 5/1991 Rebne et al.
5,174,451 A 12/1992 Niven
5,259,499 A 11/1993 Boettger
5,348,061 A * 9/1994 Riley ..... G07F 17/0092 141/104
5,358,118 A 10/1994 Thompson et al.
5,481,855 A 1/1996 Yuyama
5,522,512 A 6/1996 Archer et al.
5,548,941 A 8/1996 Portaro et al.
5,567,326 A * 10/1996 Ekenberg ..... B03C 1/0332 210/222
5,658,802 A 8/1997 Hayes et al.
5,720,154 A 2/1998 Lasher et al.
5,722,470 A * 3/1998 Kedar ..... B01J 19/0046 141/100
5,753,456 A 5/1998 Naqui et al.
5,765,606 A 6/1998 Takemasa et al.
5,771,657 A * 6/1998 Lasher ..... B65B 61/20 53/131.4
5,788,079 A * 8/1998 Bouthiette ..... A61J 7/0069 206/534
5,839,257 A 11/1998 Soderstrom et al.
5,852,911 A 12/1998 Yuyama et al.
6,023,916 A 2/2000 Bouthiette
6,074,609 A * 6/2000 Gavin ..... B01J 19/0046 422/500
6,170,230 B1 1/2001 Chudy et al.
6,318,051 B1 * 11/2001 Preiss ..... B65B 5/103 53/237
6,325,114 B1 12/2001 Bivirt et al.
6,334,980 B1 1/2002 Hayes et al.
6,471,917 B1 * 10/2002 Velkovska ..... B01J 19/0046 422/534
6,508,279 B2 * 1/2003 Siegel ..... B65B 5/103 141/2
7,185,476 B1 3/2007 Siegel et al.
7,334,379 B1 2/2008 Siegel et al.
7,721,512 B2 5/2010 Siegel et al.
7,784,244 B2 * 8/2010 Siegel ..... B65B 5/103 53/151
8,230,662 B2 * 7/2012 Boutin ..... G07F 11/165 221/211
8,516,781 B2 8/2013 Siegel et al.

OTHER PUBLICATIONS

Medical Packaging Inc.; Sales brochure for "AutoPak BPM"; USA.
European Search Report dated Mar. 7, 2003.
International Patent Application No. PCT/US01/10641, Search Report dated Jun. 14, 2001, 1 page.
International Patent Application No. PCT/US01/10641, International Preliminary Examination Report dated Aug. 28, 2002, 4 pages.
U.S. Appl. No. 09/539,834, Non-Final Office Action dated Apr. 12, 2001, 6 pages.
U.S. Appl. No. 09/539,834, Final Office Action dated Dec. 12, 2001, 6 pages.
U.S. Appl. No. 09/539,834, Restriction Requirement dated Jul. 19, 2002, 5 pages.
U.S. Appl. No. 09/539,834, Non-Final Office Action dated Dec. 4, 2002, 5 pages.
U.S. Appl. No. 09/539,834, Final Office Action dated Jul. 25, 2003, 7 pages.
U.S. Appl. No. 09/539,834, Final Office Action dated Dec. 13, 2004, 5 pages.
U.S. Appl. No. 09/539,834, Notice of Allowance dated May 10, 2005, 3 pages.
U.S. Appl. No. 09/539,834, Non-Final Office Action dated Aug. 18, 2005, 5 pages.
U.S. Appl. No. 09/539,834, Final Office Action dated Apr. 11, 2006, 8 pages.
U.S. Appl. No. 09/539,834, Advisory Action dated Aug. 15, 2006, 3 pages.
U.S. Appl. No. 09/539,834, Notice of Allowance dated Oct. 10, 2006, 3 pages.
U.S. Appl. No. 11/616,227, Non-Final Office Action dated Jul. 11, 2008, 6 pages.
U.S. Appl. No. 11/616,227, Notice of Allowance dated Mar. 11, 2009, 6 pages.
U.S. Appl. No. 11/616,227, Restriction Requirement dated Jul. 16, 2009, 7 pages.
U.S. Appl. No. 11/616,227, Notice of Allowance dated Jan. 12, 2010, 6 pages.
U.S. Appl. No. 12/786,138, Restriction Requirement dated Jan. 11, 2011, 7 pages.
U.S. Appl. No. 12/786,138, Non-Final Office Action dated Jun. 28, 2011, 5 pages.
U.S. Appl. No. 12/786,138, Final Office Action dated Jan. 23, 2012, 6 pages.
U.S. Appl. No. 12/786,138, Notice of Allowance dated Apr. 25, 2013, 8 pages.

* cited by examiner

AUTOMATED SOLID PHARMACEUTICAL PRODUCT PACKAGING MACHINE

The subject matter of application Ser. No. 12/786,138, is incorporated herein by reference. The present application is a Divisional of U.S. Ser. No. 12/786,138, filed May 24, 2010, now U.S. Pat. No. 8,516,781, issued Aug. 27, 2013, which is a Divisional of U.S. Ser. No. 11/616,227, filed Dec. 26, 2006, now U.S. Pat. No. 7,721,512, issued May 25, 2010, which is a Continuation of U.S. patent application Ser. No. 09/539,834, filed Mar. 31, 2000, now U.S. Pat. No. 7,185,476, issued Mar. 6, 2007, which is a Continuation-In-Part of U.S. Provisional Patent Application No. 60/133,647, Filed May 11, 1999. The present application claims priority to these previously filed applications. The subject matter of each of these applications is incorporated herein by reference.

BACKGROUND OF THE INVENTION

Field of the Invention

The present invention relates generally to the field of automated pharmaceutical packaging machines. More specifically, the present invention is directed to an automated pharmaceutical packaging machine which simultaneously fills a product package template with desired solid pharmaceutical dosing requirements while also simultaneously sealing a final package containing a plurality of individual patient doses.

Description of the Related Art

There currently are a wide variety of automated pharmaceutical packaging machines available. The majority of these machines are designed for packaging a single pharmaceutical product into pharmaceutical package material. These machines typically transfer individual doses of solid pharmaceutical products into a cavity formed within a clear plastic cover member. Usually a plurality of cavities are formed in a single sheet of clear plastic material and a corresponding plurality of pharmaceutical products are inserted by the filling machine. Once the solid pharmaceutical members have been inserted into the cavities, a backing material is then adhesively applied to the clear plastic sheet to seal the solid pharmaceutical products within the cavities.

These automated machines satisfy the majority of solid pharmaceutical packaging requirements where a single product is inserted into a package. However, especially in managed care facilities, there is a significant need for an automated pharmaceutical packaging machine which is capable of selectively depositing one or more pharmaceuticals into each of the individual cavities in a pharmaceutical product package.

Managed care facilities now use patient specific packaging that provide all of a patient's prescription drug needs for a given period of time. Existing packaging solutions typically employ solid pharmaceutical product package cards that contain all the given patients' dosages for a one week period of time. Each dose of one or more pharmaceuticals is stored in a clear plastic cavity. These dosing cards usually include three to four different clear plastic cavities for any given day that correspond with each prescribed dosage time for a patient's medication requirements. Currently there are no automated systems for selectively filling a plurality of different dosing cavities with a plurality of different solid pharmaceutical medications for a single patient and which are also capable of simultaneously sealing the package cavities.

As a result, it is necessary that the managed care facility go through a more time consuming process in order to create a package containing a patient's dose of solid pharmaceuticals for a given period of time. Accordingly, there remains a need in the art for an automated pharmaceutical packaging machine which is capable of automatically selecting and depositing one or more solid pharmaceutical products into a plurality of medication packages for a patient while also simultaneously sealing and further processing a solid pharmaceutical product package.

SUMMARY OF THE INVENTION

The present invention overcomes the shortcomings of the prior art and provides a fully automated pharmaceutical product packaging machine which is capable of selectively depositing one or more different solid pharmaceutical products into an individual cavity for each of a plurality of individual patient product package cavities. The system that is descried below is a fully automated machine which is computer controlled and employs a plurality of solid pharmaceutical product dispensing canisters. Each of these solid pharmaceutical dispensing canisters is capable of selectively dispensing a pre-designated number of solid pharmaceutical products. The canisters are programmable and can be manipulated with a computer controller. These canisters are capable of selecting individual pills regardless of their size or shape and are commercially available.

The system of the present invention employs an array of canisters arranged within a mechanical feeding mechanism. Each canister is designed to feed a funnel or trough which transmits a solid pharmaceutical product selectively dispensed from one of the canisters into a cavity of a product package template. A plurality of pharmaceuticals may be selected for a single cavity member. This step is repeated for each of the plurality of cavities in template that corresponds with the cavities in a single sheet or card of cavities that provide a patient's dosing requirements for a given period of time.

For example, a single sheet may typically include all of the solid pharmaceutical products that have been prescribed for a patient during a one week period. The patient's doctor may have prescribed three or four different administration times during the week and accordingly the dosing card has typically between 21 and 28 different individual cavities. Each of the cavities are capable of holding a volume of solid pharmaceuticals necessary for patient dosing requirements. Once the template containing temporary storage cavities for each combination of drugs has been filled, the template is automatically positioned over a sheet of clear plastic material containing a plurality of cavities corresponding to the cavities in the template. A barrier between the cavities in the template and the sheet of clear plastic material is shifted or moved and the pharmaceuticals in the template cavities drop into the corresponding cavities in the clear plastic sheet of material. The clear plastic sheet of material is then maneuvered into subsequent product packaging stations and the template is returned to beneath the canister region. The template member is selectively moveable through a range of motion defined by an X-Y axis so that each cavity of the template may be selectively positioned beneath the feed mechanism for transfer of pharmaceuticals located in the canisters.

The system then simultaneously fills the template with either the dosing requirements for the same patient for another week or the dosing requirements for another patient for a given period of time. While the template is being filled, the sheet of clear plastic material now containing each of the solid pharmaceutical doses for the first patient are then simultaneously enclosed and packaged into a final package that may be given to a patient or the care givers for the patient so that the prescribed pharmaceuticals may be administered from the product package. Advantageously, the machine saves a significant amount of time by simultaneously filling the template while also packaging the previously selected pharmaceuticals. The present invention employs canisters which are commercially available for selectively for dispensing the desired quantity of solid pharmaceutical products. In order to complete the packaging process, a sheet of backing material is secured to the clear plastic members to enclose the pharmaceutical products within the clear plastic cavities as is known in the art. The machine of the present invention makes use of pneumatically controlled automated machinery for packaging and manipulating the product. Additionally, the system of the present invention includes pharmaceutical product package and sealing stations.

DETAILED DESCRIPTION OF THE PRESENTLY PREFERRED EMBODIMENTS

Figure 1:
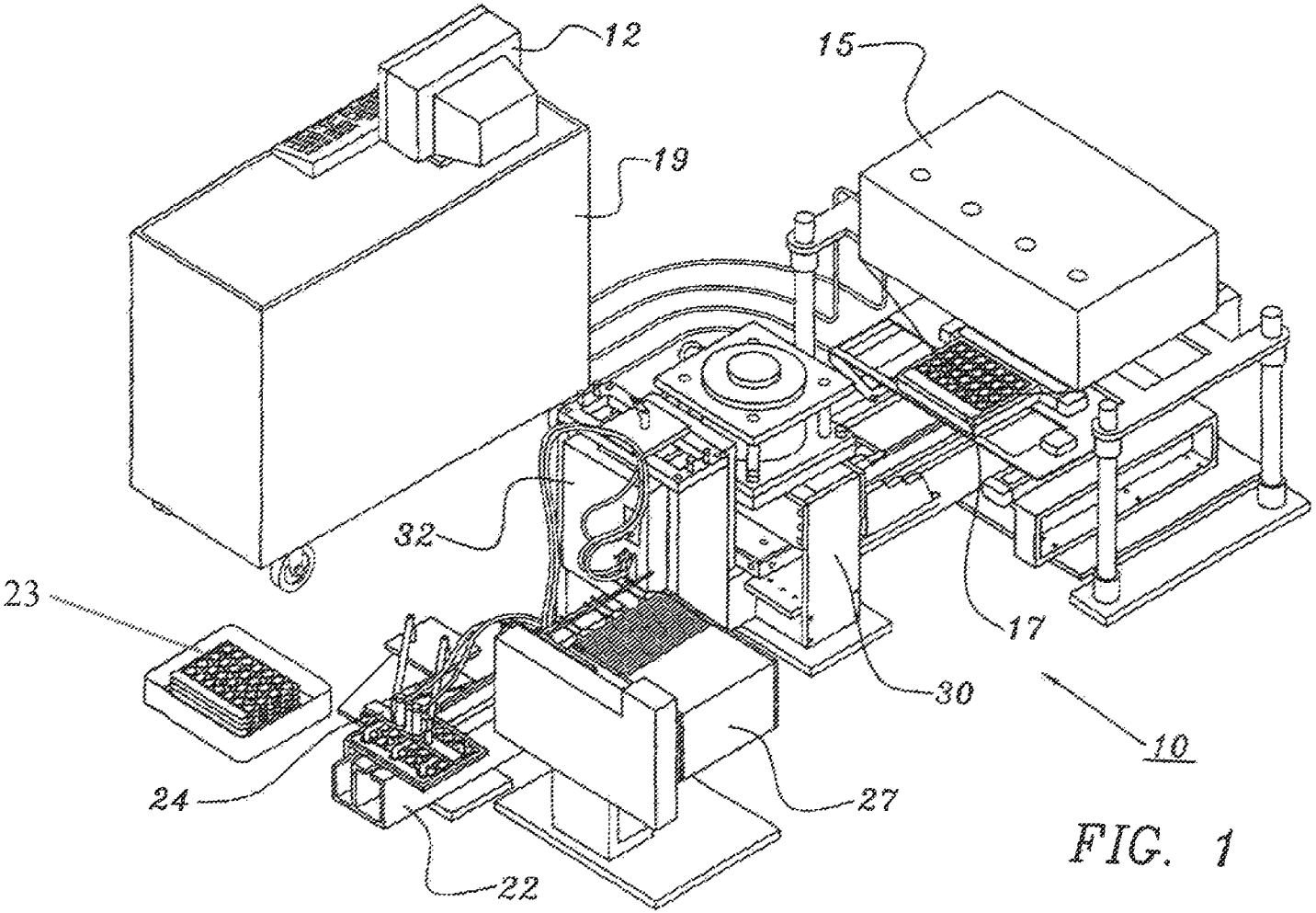
FIG. 1 illustrates a first embodiment of the present invention.

An embodiment of a fully automated pharmaceutical product packaging machine which is capable of selectively depositing one or more different solid pharmaceutical products into an individual cavity for each of a plurality of individual patient product package cavities is shown generally at 10 in FIG. 1. A computer 12 is linked with the various members of the system to control their respective operations. The system employs a plurality of solid pharmaceutical product dispensing canisters each of which are mounted in a pharmaceutical dispensing mechanism 15. The pharmaceutical dispensing canisters are commercially available products. Each of the solid pharmaceutical dispensing canisters located within the pharmaceutical dispensing mechanism 15 is capable of selectively dispensing a pre-designated number of solid pharmaceutical products. The canisters are each independently programmable and can be manipulated via the computer controller 12. The canisters are capable of selecting individual pills regardless of their size or shape.

Each canister is arranged within the pharmaceutical dispensing mechanism to feed a funnel or trough which transmits a solid pharmaceutical product selectively dispensed from one or more of the canisters into a cavity of a product package template 17. This step is repeated for each of the plurality of cavities in the template 17 that corresponds with the cavities in a single sheet or card of cavities in a package that provide a patient's dosing requirements for a given period of time. The template member 17 is selectively moveable through a range of motion defined by an X-Y axis so that each cavity of the template 17 may be selectively positioned beneath the feed mechanism of the pharmaceutical dispensing mechanism 15 for transfer of pharmaceuticals located in the canisters located therein. The dispensing mechanism 15 has a plurality of canisters that are controlled by signals from the computer. Each of the canisters may have a separate address so that the canisters will only respond to commands intended for the selected canister.

FIG. 1 also illustrates a cart 19 for convenient location of the computer controller 12. The moveable cart 19 may also provide a location for a pneumatic drive generator that is used in driving the stations of the machine. A package transfer track is shown at 22 and provides a mechanism for transferring a pharmaceutical product package 23 between each of the separate stations of the machine. A lift mechanism 24 lifts and transfers filled pharmaceutical product packages 23 from the transfer track 22.

A product package dispensing unit is shown at 27 and transfers empty package members onto the transfer track 22. Those skilled in the art will appreciate that one or more product package dispensing members may be used for transferring portions of packages to the filling machine. The system of the present invention also includes a product package sealing station 30 and a printing station 32. The product package dispensing unit 27 is shown adjacent the printing station 32, however, it is preferred that each package dispensing station be located adjacent or near the pharmaceutical product dispensing unit 15. This eliminates travel of the product package during the manufacturing process and also enables the filling of the pharmaceutical package template to take place simultaneously with sealing and/or further processing of another package member.

Each of the cavities of a pharmaceutical product package are capable of holding a volume of solid pharmaceuticals necessary for patient dosing requirements. Once the template 17 containing temporary storage cavities for each combination of drugs has been filled, the template is automatically positioned over a portion of a pharmaceutical product package comprising a sheet of clear plastic material containing a plurality of cavities. The cavities in the clear plastic material correspond to the cavities in the template. A barrier between the cavities in the template 17 and the sheet of clear plastic material is moved when the desired number of cavities have been filled and the pharmaceuticals in the template cavities drop into the corresponding cavities in the clear plastic sheet of material.

The clear plastic sheet of material is then maneuvered adjacent to at least one package sealing member and the combined structure of the now filled plastic sheet and the sealing member is then transferred along transfer track 22 to the product package sealing station 30. While this occurs, the template 17 is returned to beneath the pharmaceutical dispensing mechanism 15.

The system 10 then simultaneously fills the template with either the dosing requirements for the same patient for another week or the dosing requirements for another patient for a given period of time. While the template 17 is being filled, the sheet of clear plastic material now containing each of the solid pharmaceutical doses for the first patient are then simultaneously enclosed and sealed by the sealing station 30 into a final package that may be given to a patient or the are givers for the patient so that to prescribed pharmaceuticals may be administered from the product package. A sheet of backing material is secured to the clear plastic members to enclose the pharmaceutical products within the clear plastic cavities as is known in the art.

Advantageously, the machine saves a significant amount of time by simultaneously filling the template while also packaging the previously selected pharmaceuticals. The machine of the present invention desirably makes use of pneumatically controlled automated machinery for packaging and manipulating the product, however, those skilled in the art will appreciate that the machine of the present invention may be powered by any conventional or future developed drive mechanism. For example stepping motors may be used for mechanical manipulation of various elements as described above.

Figure 2:
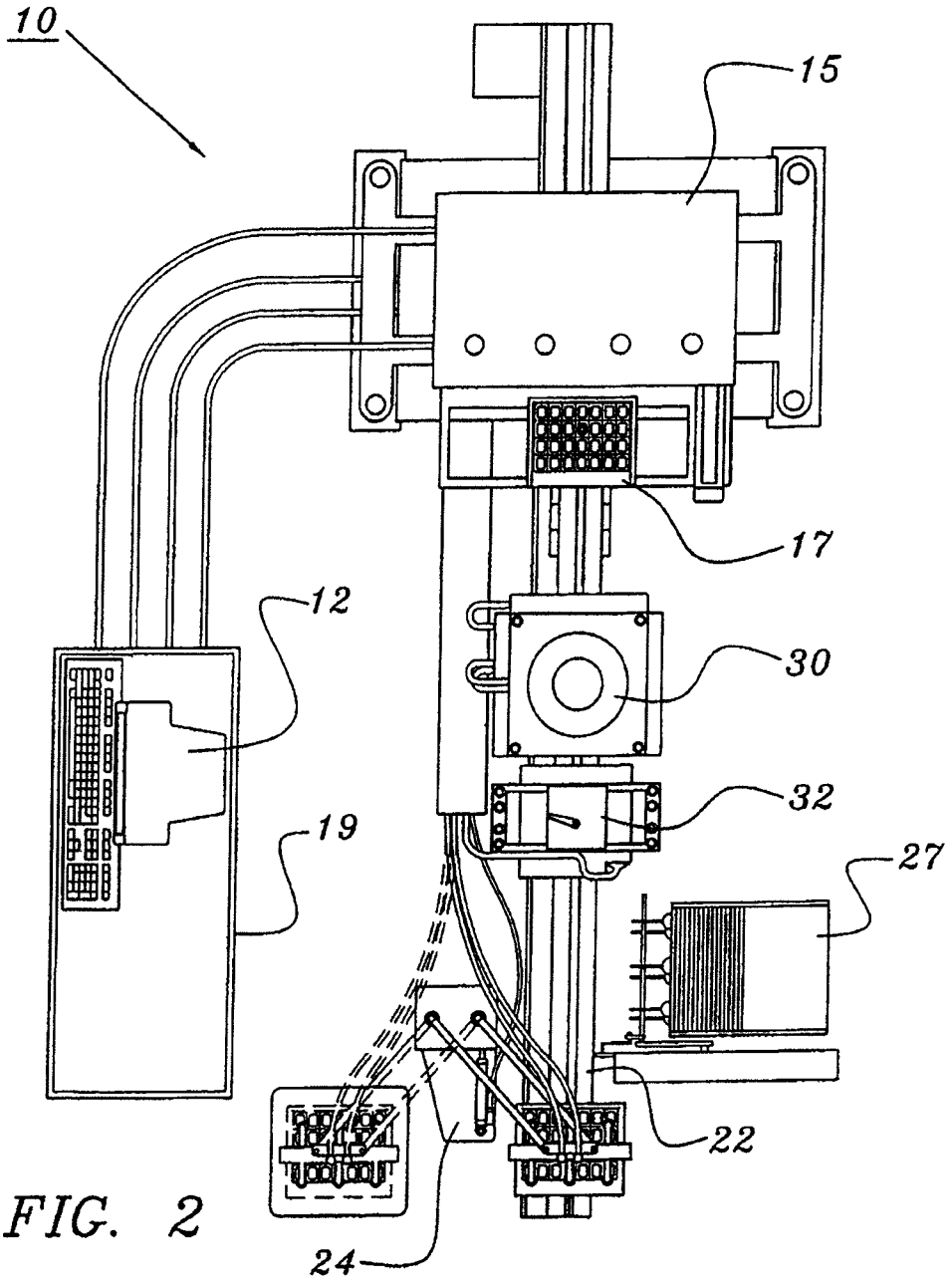
FIG. 2 illustrates a top plan view of the embodiment of the device set forth in FIG. 1.

FIG. 2 illustrates a top plan view of the system described above with reference to FIG. 1. FIG. 2 illustrates the relative spacing of the various manufacturing stations described above. As noted, it is actually preferred that the empty product package dispensing station 27 actually be located adjacent the pharmaceutical dispensing station 15. Additionally, those skilled in the art will appreciate that additional product package dispensing stations may be inserted between the sealing station 30 and the pharmaceutical dispensing mechanism depending on the number of distinct package elements that to be sealed together by the sealing station 30.

Figure 3:
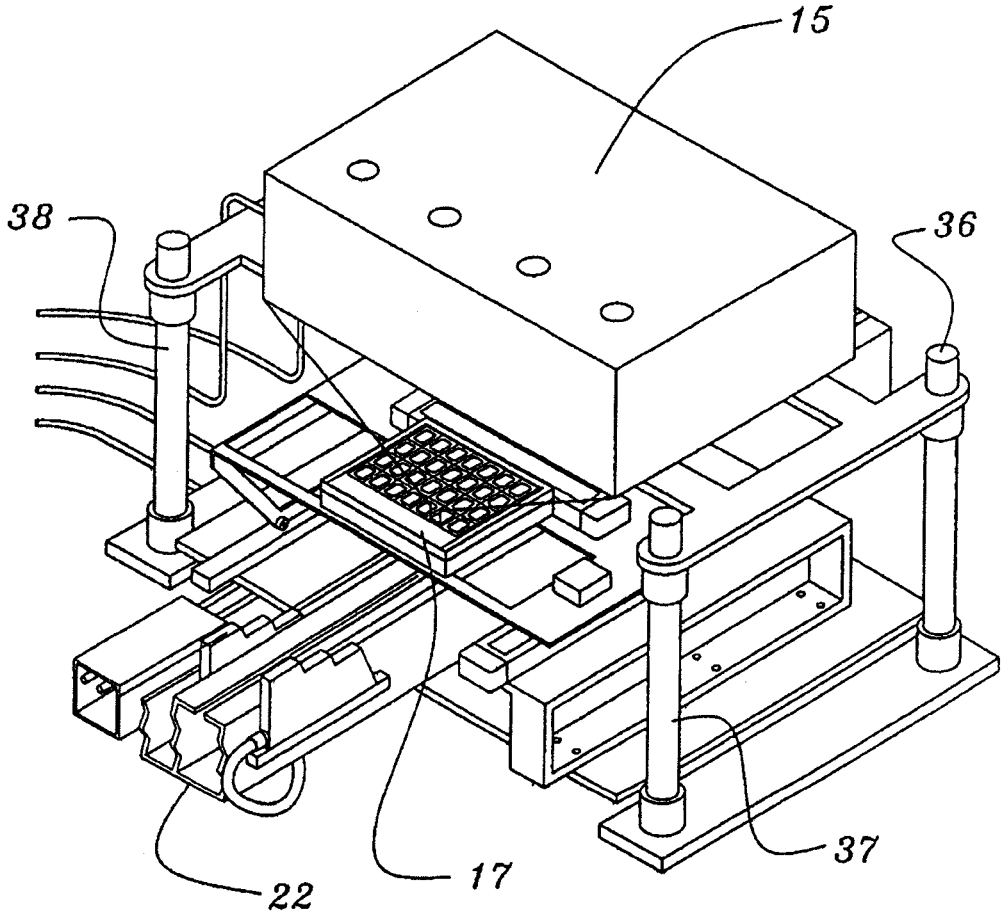
FIG. 3 illustrates an automated canister delivery mechanism.
Figure 4:
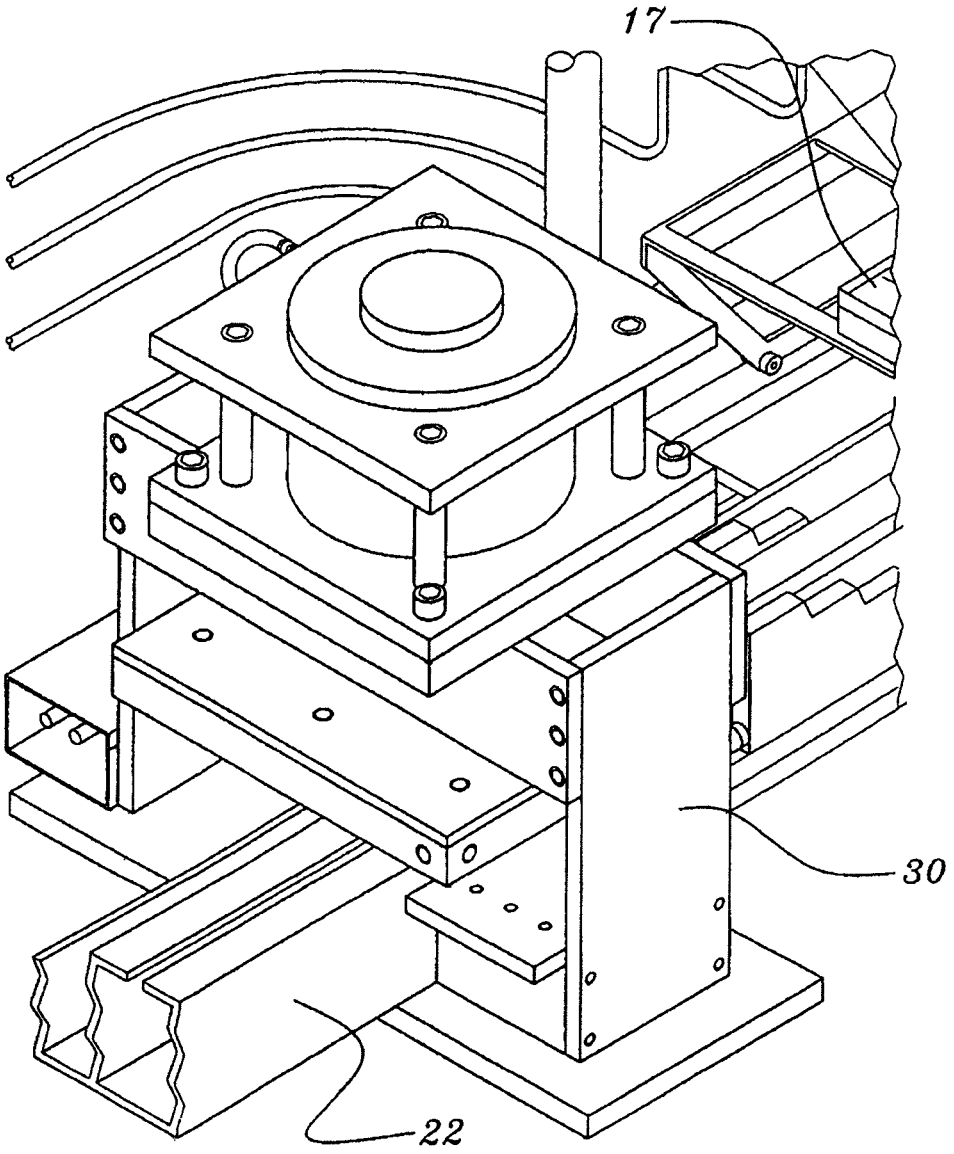
FIG. 4 illustrates a machine that is used in transferring solid pharmaceuticals from a template into a sheet of clear plastic material having cavities for receiving solid pharmaceutical products.

FIG. 3 illustrates the pharmaceutical product dispensing unit 15 as well as the template member 17. As shown in FIG. 3, the pharmaceutical product dispensing unit 15 is supported by structural support members 36, 37, and 38. Control lines 42 connect the canisters with the computer 12 so that the desired pharmaceuticals may be dispensed by the machine. FIG. 4 is a detailed view of the package sealing station 30. As shown in FIG. 4, the product package transfer track 22 passes directly beneath the sealing station 30. The sealing station 30 may be comprised of any conventional sealing mechanism. For example, this sealing station 30 may be capable of applying heat or pressure or some type of electromagnetic radiation or combinations of these sealing techniques in order to set any adhesives that has been previously applied to the product packaging material. One significant feature is that the relationship of these structures allows for simultaneously filling the product template while also sealing another filled package or otherwise further processing the package.

Figure 5:
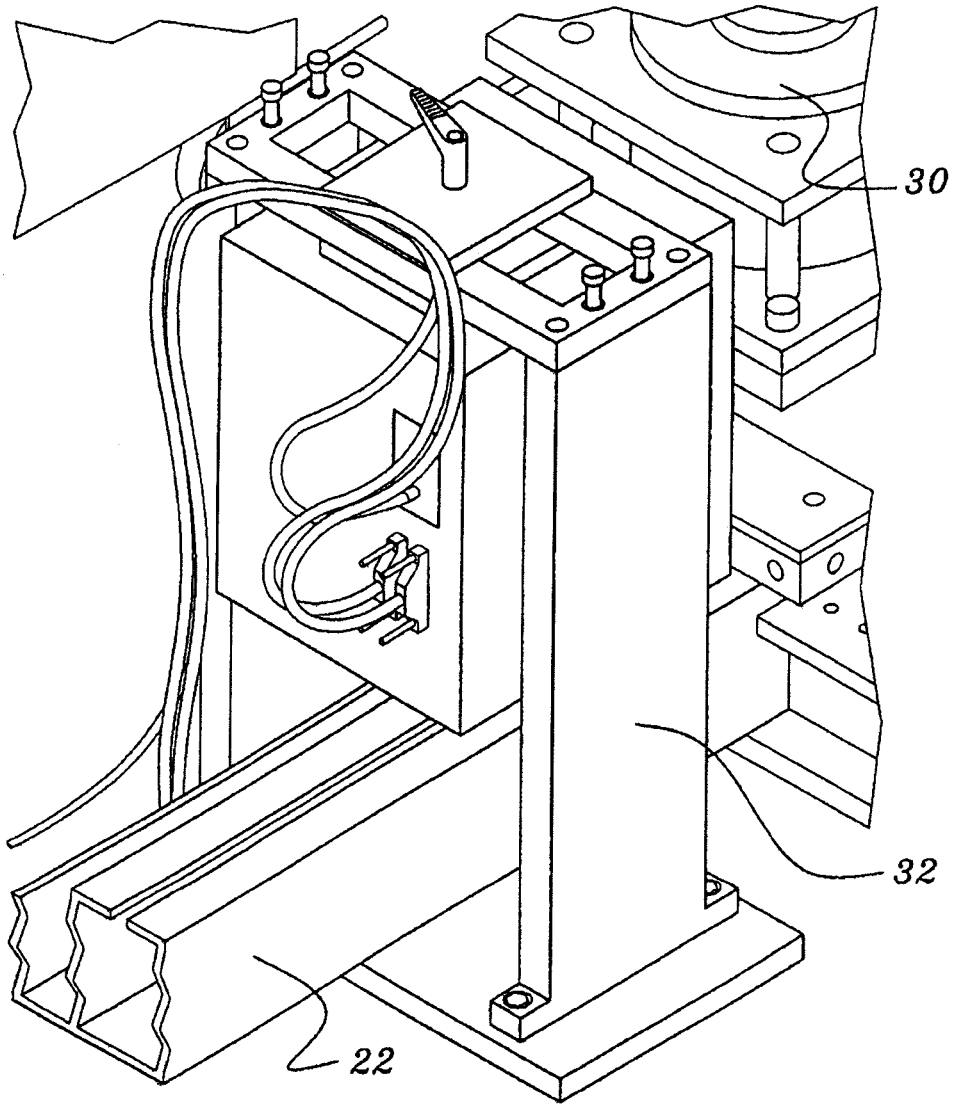
FIG. 5 illustrates a machine for selectively sealing backing member onto a clear plastic sheet.

FIG. 5 illustrates a conventional printing station that is mounted above the pharmaceutical product package transfer track 22. This station prints information on the sealed product package which may relate to such things as identification of the patient, the time and dates for which the medication has been prescribed as well content information and/or expiration information. Significantly, this station is also capable of operating in parallel and independent from the pharmaceutical dispensing station 15.

Figure 6:
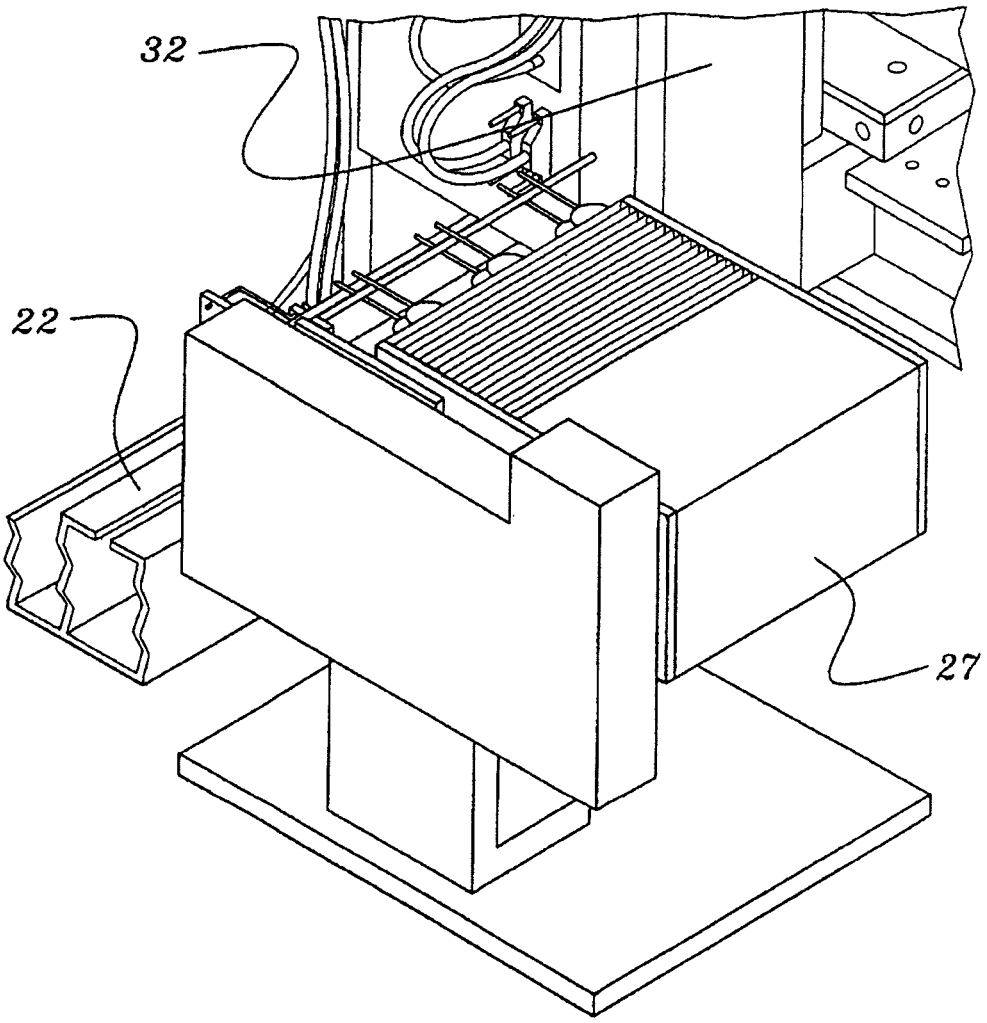
FIG. 6 illustrates a machine that is used in dispensing the backing material for the cards.

FIG. 6 illustrates the pharmaceutical product package dispensing station 27. This station is also typical of known automated product package dispensing devices. The station is desirably mounted adjacent the product package transfer track 22 so that product packages or partial packages may be readily placed on the track member 22. As noted it is preferred that one or more of these stations be located between the sealing station 30 and the dispensing station 15.

Figure 7:
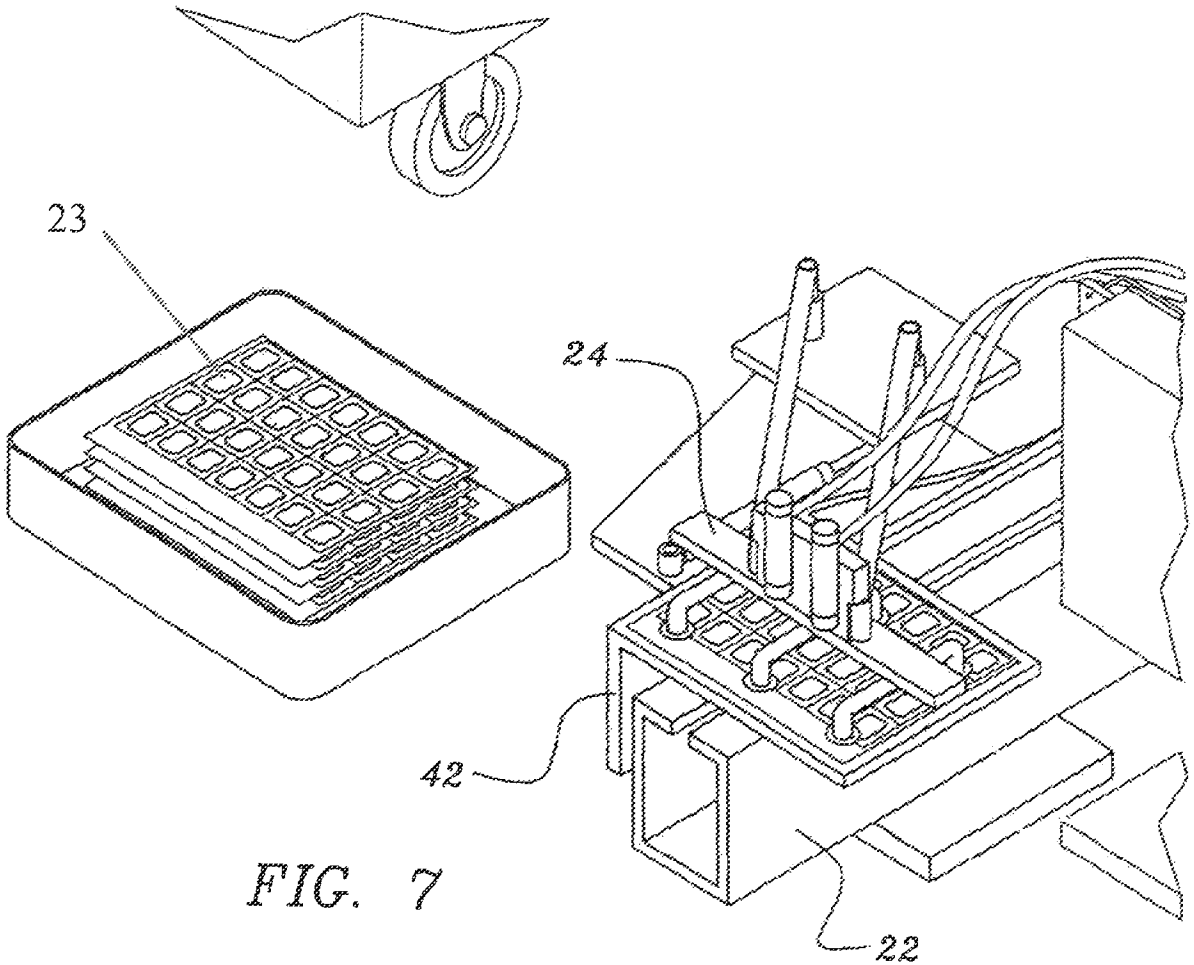
FIG. 7 illustrates a machine that is used for lifting the finished product from the assembly line.

FIG. 7 illustrates an automated device 24 which automatically removes the completed product packages from the transfer track 22. FIG. 7 also illustrates a completed package located on the transfer mechanism 42 which is mounted in the product package transfer track 22.

We claim:

1. A system for filling solid pharmaceutical product packaging, comprising:

a storage means for storing patient specific prescription data in an electronic memory associated with a computer controller;

a means for automatically effecting relative motion along multiple axes to locate a first solid pharmaceutical product cavity location of an array of cavity locations beneath a dispensing passageway for a first solid pharmaceutical dispensing canister, wherein the array of cavity locations comprises a plurality of cavities, each of the plurality of cavities corresponding to a different cavity formed within a product package wherein the array of cavities has a same number of cavities in a same arrangement as the product package;

means for automatically causing the first solid pharmaceutical dispensing canister to eject a solid pharmaceutical product into the first cavity location;

means for automatically effecting relative motion along multiple axes to selectively locate a second solid pharmaceutical product cavity location beneath a dispensing passageway for a second solid pharmaceutical dispensing canister;

means for automatically causing the second solid pharmaceutical dispensing canister to eject a solid pharmaceutical product into the second cavity; and means for automatically effecting relative motion for each remaining cavity location of the array of cavity locations and the canisters and automatically dispensing one or more solid pharmaceutical products from each of a plurality of dispensing canisters corresponding to a prescribed dose at a dosing time for the specific patient corresponding at each cavity location until all cavities for the patient prescription have been filled.

2. The system for filling solid pharmaceutical product packaging of claim 1, further comprising:

a means for aligning the array of cavity locations with corresponding cavities of the product package; and a means for transferring the solid pharmaceutical products from each cavity location of the array of cavity locations to a corresponding one of the cavities of the product package.

3. The system for filling solid pharmaceutical product packaging of claim 2, further comprising:

a means for sealing the product package.

4. The system for filling solid pharmaceutical product packaging of claim 3, further comprising:

a means for printing information on the product package.

5. The system for filling solid pharmaceutical product packaging of claim 1, further comprising:

a means for sealing the product package and a means for transferring the array of cavity locations to a position beneath a dispensing passageway for receiving solid pharmaceutical products simultaneously to the product package being sealed.

6. The system for filling solid pharmaceutical product packaging of claim 1, wherein:

each of the plurality of dispensing canisters comprises a unique address for use by the computer controller.

7. The system for filling solid pharmaceutical product packaging of claim 1, wherein:

the multiple axes are perpendicular to one another.

8. A system for filling solid pharmaceutical product packaging, comprising:

a template member having a plurality of cavities that are each to receive one or more solid pharmaceutical products, wherein each of the plurality of cavities of the template member corresponds to a different cavity formed within an empty product package wherein the template member has a same number of cavities in a same arrangement as the empty product package;

a pharmaceutical dispensing mechanism to:

receive a plurality of solid pharmaceutical canisters;

move the template member along at least two axes wherein each of the plurality of cavities is positionable beneath a feed mechanism of the plurality of solid pharmaceutical canisters; and cause at least one of the plurality of the solid pharmaceutical canisters to eject at least one solid pharmaceutical product into at least one of the plurality of cavities of the template, wherein the at least one solid pharmaceutical product corresponds to a prescribed dose at a dosing time for a specific patient corresponding at each cavity location until all cavities for a patient prescription have been filled; and a computer system to:

store patient specific prescription data; and control the ejection of solid pharmaceutical products by the pharmaceutical dispensing mechanism.

9. The system for filling solid pharmaceutical product packaging of claim 8, wherein:

the pharmaceutical dispensing mechanism is further to:

maneuver a filled template over the empty product package such that the plurality of cavities are aligned with corresponding cavities of the empty product package; and transfer the solid pharmaceutical products from each cavity of the plurality of cavities to a corresponding one of the cavities of the product package.

10. The system for filling solid pharmaceutical product packaging of claim 9, further comprising:

a sealing station that is to seal the filled product package.

11. The system for filling solid pharmaceutical product packaging of claim 10, further comprising:

a printing station that is to print information onto the sealed product package.

12. The system for filling solid pharmaceutical product packaging of claim 11, further comprising:

a track that is configured to maneuver the product package between the pharmaceutical dispensing mechanism, the sealing station, and the printing station.

13. The system for filling solid pharmaceutical product packaging of claim 8, wherein:

each of the plurality of the solid pharmaceutical canisters comprises a unique address for use by the computer system.

14. The system for filling solid pharmaceutical product packaging of claim 8, wherein:

the at least two axes are perpendicular to one another.

15. A method for filling solid pharmaceutical product packaging, comprising:

storing patient specific prescription data in an electronic memory associated with a computer controller;

automatically effecting relative motion along multiple axes to selectively locate a first solid pharmaceutical product cavity location of an array of cavity locations of a template member beneath a dispensing passageway for a first solid pharmaceutical dispensing canister, wherein each cavity location of the array of cavity location of the template member corresponds to a different cavity formed within a product package wherein the template member has a same number of cavity locations in a same arrangement as the product package;

automatically causing the first solid pharmaceutical dispensing canister to eject a solid pharmaceutical product into the first cavity location;

automatically effecting relative motion along multiple axes to selectively locate a second solid pharmaceutical product cavity location beneath a dispensing passageway for a second solid pharmaceutical dispensing canister;

automatically causing the second solid pharmaceutical dispensing canister to eject a solid pharmaceutical product into the second cavity location; and automatically effecting relative motion along multiple axes for each remaining cavity location of the array of cavity locations and the canisters and automatically dispensing one or more solid pharmaceutical products from each of a plurality of dispensing canisters corresponding to a prescribed dose at a dosing time for the specific patient corresponding at each cavity location until all cavity locations for the patient prescription have been filled.

16. The method for filling solid pharmaceutical product packaging of claim 15, further comprising:

aligning the array of cavity locations with corresponding cavities of the product package; and transferring the solid pharmaceutical products from each cavity location of the array of cavity locations to a corresponding one of the cavities of the product package.

17. The method for filling solid pharmaceutical product packaging of claim 16, further comprising:

sealing the product package.

18. The method for filling solid pharmaceutical product packaging of claim 17, further comprising:

printing information on the product package.

19. The method for filling solid pharmaceutical product packaging of claim 15, further comprising:

simultaneously sealing the product package and transferring the array of cavity locations to a position beneath a dispensing passageway for receiving solid pharmaceutical products while the product package is being sealed.

20. The method for filling solid pharmaceutical product packaging of claim 15, wherein:

each of the plurality of dispensing canisters comprises a unique address for use by the computer controller.

* * * * *